US011745508B2

(12) United States Patent
Caballero Diaz et al.

(10) Patent No.: US 11,745,508 B2
(45) Date of Patent: Sep. 5, 2023

(54) PRINTHEAD SERVICING WITH HUMIDIFIED AIR STREAM AND WIPING MODULES

(71) Applicant: HEWLETT-PACKARD DEVELOPMENT COMPANY, L.P., Spring, TX (US)

(72) Inventors: Carlos Eduardo Caballero Diaz, Sant Cugat del Valles (ES); Francesc Tarrida Tirado, Sant Cugat del Valles (ES); Javier Deocon Mir, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 137 days.

(21) Appl. No.: 17/310,126

(22) PCT Filed: Jun. 28, 2019

(86) PCT No.: PCT/US2019/039836
§ 371 (c)(1),
(2) Date: Jul. 19, 2021

(87) PCT Pub. No.: WO2020/263274
PCT Pub. Date: Dec. 30, 2020

(65) Prior Publication Data

US 2022/0048292 A1 Feb. 17, 2022

(51) Int. Cl.
*B41J 2/165* (2006.01)

(52) U.S. Cl.
CPC ..... *B41J 2/16552* (2013.01); *B41J 2/165* (2013.01); *B41J 2/16538* (2013.01); *B41J 2002/16555* (2013.01)

(58) Field of Classification Search
CPC ..... B41J 2/16552; B41J 2/165; B41J 2/16538
See application file for complete search history.

(56) References Cited

U.S. PATENT DOCUMENTS 4,364,065 A 12/1982 Yammamori et al.
5,790,147 A * 8/1998 Hensel ..... B41J 2/16552 347/49
5,914,734 A 6/1999 Rotering et al.
6,158,838 A * 12/2000 Capurso ..... B41J 2/16552 347/29
6,497,471 B1 12/2002 Gargir
6,682,165 B2 1/2004 Yearout
8,636,337 B2 1/2014 Shinoda
(Continued)

FOREIGN PATENT DOCUMENTS

AU 709732 B * 9/1999 ..... B41J 2/16552
JP 2003165230 A * 6/2003
(Continued)

*Primary Examiner* — Sharon Polk
(74) *Attorney, Agent, or Firm* — Shook, Hardy & Bacon L.L.P.

(57) ABSTRACT

A printhead servicing system comprises a humidified air stream generator (10) to generate a humidified air stream; a humidified air stream channeling module (20) to channel the generated humidified air stream to a humidified air stream ejection module (30) to eject the humidified air stream towards a printhead nozzle plate (52*a*) of a printer (50); and a wiping module (40) to wipe a printhead nozzle plate (52*a*) of the printer.

13 Claims, 6 Drawing Sheets

(56) References Cited

U.S. PATENT DOCUMENTS

| | | | |
|---|---|---|---|
| 8,757,754 | B2 | 6/2014 | Azuma et al. |
| 9,315,029 | B2 | 4/2016 | Fernando et al. |

FOREIGN PATENT DOCUMENTS

| | | | | |
|---|---|---|---|---|
| KR | 20070091817 | A | * | 9/2007 |
| RU | 2497683 | C2 | | 11/2013 |
| WO | WO-2004108416 | A1 | | 12/2004 |
| WO | WO-2016063539 | A1 | | 4/2016 |

* cited by examiner

PRINTHEAD SERVICING WITH HUMIDIFIED AIR STREAM AND WIPING MODULES

In some printing systems printing liquid is ejected from a nozzle plate for printing. Servicing of the nozzle plate is generally beneficial for a variety of reasons, such as to prevent a build-up of dried printing liquid.

DETAILED DESCRIPTION

Figure 1:
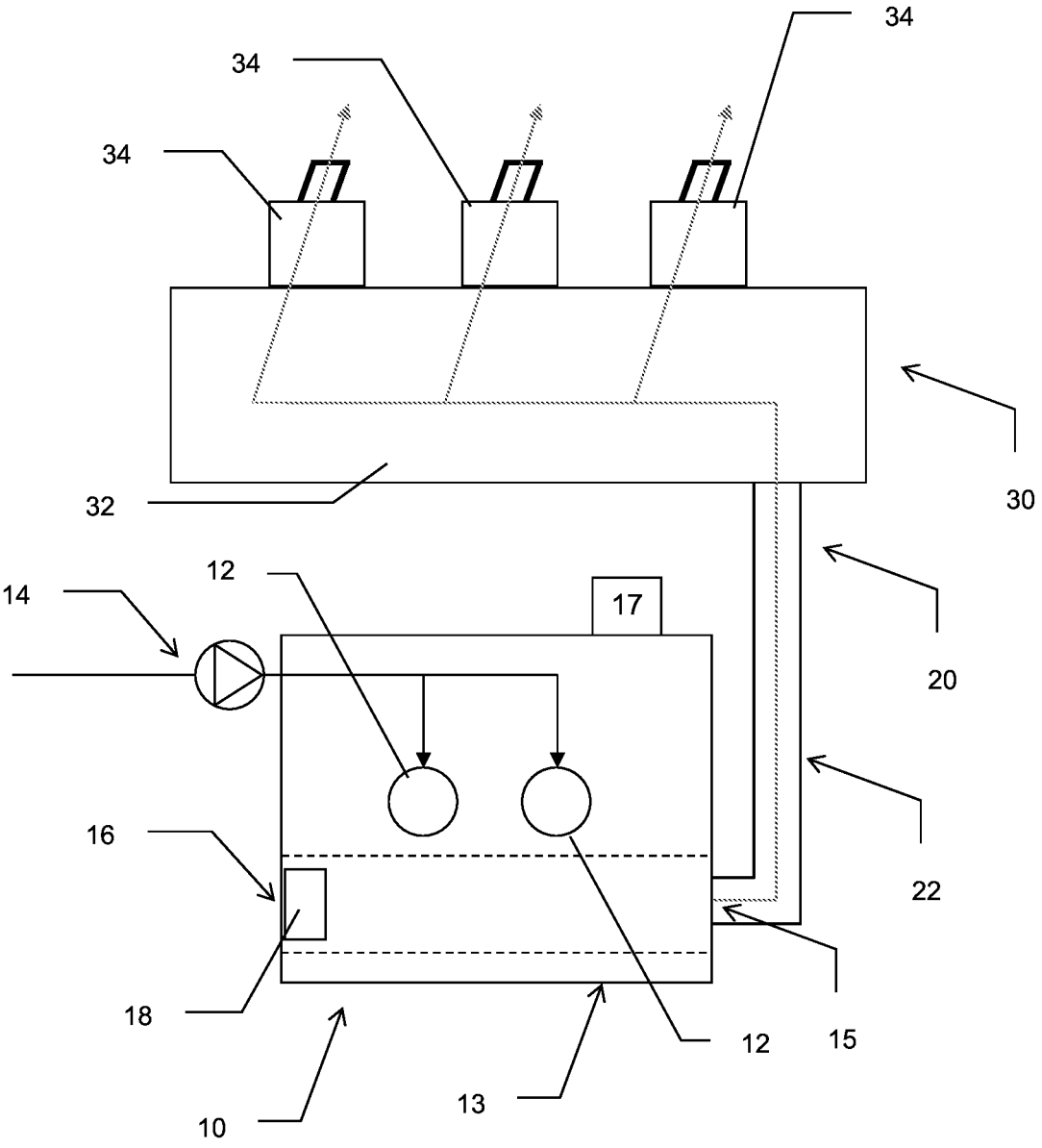
FIG. 1 is a schematic view of a printhead servicing system according to one example.

In 3D printing systems that use scanning printheads (such as thermal or piezo printheads) to deposit printing agents and many 2D printing systems, one or more printheads are passed in a reciprocating movement over a print zone. Printheads typically comprise a nozzle plate, which is generally planar with nozzle openings therein from which printing fluid is ejected for printing. The nozzles are typically a few tens of microns across.

Servicing of the nozzle plate is beneficial to address, for example, any build-up of dried printing fluid that can accumulate around nozzle openings. A build-up of dried printing fluid can cause mis-firing of one or more nozzles of the nozzle plate, which produces noticeable image quality defects, such as microbanding or white lines. Also, a nozzle can misdirect printing fluid if a nozzle is partially clogged. A clogged nozzle can also increase a temperature of the nozzle plate, because there is a reduction in the amount of heat removed from the nozzle plate due to the flow of printing fluid being reduced when one or more nozzles are clogged. The increase in nozzle plate temperature can increase the likelihood of the ejected printing fluid drying on the nozzle plate.

The formation of a crust of dried printing fluid is due to the loss of humidity in the meniscus of the printing fluid at the nozzle and the remnants of printing fluid in the surrounding space. The main contributing factors to the presence of dried printing fluid are a high printing fluid droplet firing frequency (which increases the temperature of the nozzle plate), a low humidity of air in contact with the nozzles, a printing time and a printing fluid composition.

A printhead servicing system is shown schematically in FIGS. 1 and 2 and comprises a humidified air stream generator 10, a humidified air stream channeling module 20, a humidified air stream ejection module 30, a wiping module 40 (shown in FIG. 2) and a controller 17, the function and construction of which elements will be described below.

In FIG. 1, the humidified air stream generator 10 comprises two mist generators 12 having a water supply 14, which takes a supply of water and produces a mist by atomizing the water into small droplets. In this example the mist generators 12 are ultrasonic mist generators that produce a mist using high frequency (ultrasonic) vibrations. Other types of mist generator that could be used include the use of pressurized water forced through an atomizing nozzle to produce a mist and the use of unpressurised water pushed forced through an atomizing nozzle with compressed air. In these examples, the mist generator 12 provides minimal or no heating of the mist, so that a cooling effect of the humidified air stream is improved. Although in this example there are two mist generators, one or more than two can be used.

The main purpose of the mist generator 12 is to produce many small water droplets, so as to facilitate the humidification of the surrounding air by the water droplets evaporating into the surrounding air. Use of the mist generator also provides a cooling effect on the mist and surrounding air due to the heat energy required for a phase change of water droplets as they evaporate into the surrounding air. The expansion of the water or water and air through an atomizing nozzle also provides a cooling effect.

The humidified air stream generator 10 also includes an air supply 16, which is simply an air inlet from the surroundings of the system into the humidified air stream generator 10. The air supply will provide air with a relative humidity, for example measured by a hygrometer, of the environment.

The humidified air stream generator 10 also includes an air stream accelerator 18, which in this example is an axial fan. Examples of other air stream accelerators 18 that could be used include radial fans, air blowers and compressed air feeds.

The humidified air stream generator 10 also includes a housing 13, which in this example is cuboidal in shape, in which are located the mist generators 12 and the air stream accelerator 18. The air stream accelerator 18 is directed towards an outlet 15 of the humidified air stream generator 10 and generates an accelerated air stream that generally passes between the horizontal dashed lines shown in the lower part of FIG. 1 inside the housing 13 from the air stream accelerator 18 to the outlet 15. The mist generators 12 are located above the path of the generated accelerated air stream and have outputs directed downwards towards the path of accelerated air stream, so that mist falls into the path of the accelerated airstream and is directed to the outlet 15.

The humidified air stream channeling module 20 comprises a duct 22, which in this example is circular in cross-section, to channel the generated humidified air stream from the humidified air stream generator 10 to the humidified air stream ejection module 30.

At the outlet 15 of the humidified air stream generator 10 the humidified air may contain droplets that have not yet undergone a phase change to evaporate in to the air stream. If these droplets were to be sprayed on to nozzle plates of the printheads (see FIG. 2), then there is a significant risk that moisture on the nozzle plates would reduce image quality. Thus, the travel of the humidified air stream along the duct 22 of the humidified air stream channeling module 20 allows the mist from the mist generators 12 to evaporate into the air and allow droplets to dissipate so that they are not ejected on to the nozzle plates. The duct 22 may have a length of e.g. 1-2 meters, to allow sufficient time as the mist and air travels along the duct 22 for the mist to evaporate. This results in a humid and cool air stream, with a humidity that is close to saturation, for ejecting onto the nozzle plates, as described below.

The humidified air stream ejection module 30 comprises a cuboidal chamber 32 to which an exit end of the duct 22 is attached to feed the humidified air stream into the chamber 32. The chamber 32 may be made of moulded plastics material, thermoformed plastics material, bent sheet metal, or press-formed metal. The chamber 32 includes openings 34, which in this example are in the form of nozzles. In other examples only one nozzle may be provided. The nozzles direct the humidified air stream towards the nozzle plates, as indicated by the arrows in FIG. 1, which show the passage of the humidified air stream from the humidified air stream generator 10 to the humidified air stream ejection module 30 and out of the openings 34.

The nozzles may be arranged with an ejection angle to the chamber 32 that is less than 90 degrees, and may be in the region of 70 degrees to 80 degrees. The angle of ejection is chosen to improve the application of the humidified air stream to the nozzle plates. With an angle less than 90 degrees as mentioned above, there may be benefits in the airstream being directed underneath a developing crust on the nozzle plates.

The wiping module 40 is provided to remove residual printing fluid from the nozzle plates 52*a* by wiping blades 42 making contact with the nozzle plates as the carriage scans forward and backward over the wiping module 40 during a printing operation. A normal force is exerted between the wiping blades 42 and the nozzle plates to cause friction between the two and thereby wipe residual printing fluid from the nozzle plates.

The wiping module 40 may be an existing type, which may typically use silicone rubber wiping blades or ethylene propylene diene monomer (EPDM) rubber wiping blades.

The controller 17 is used to control the operation of the mist generators 12 and water supply 14 and air stream accelerator 18, as well as the wiping module 40.

Figure 2:
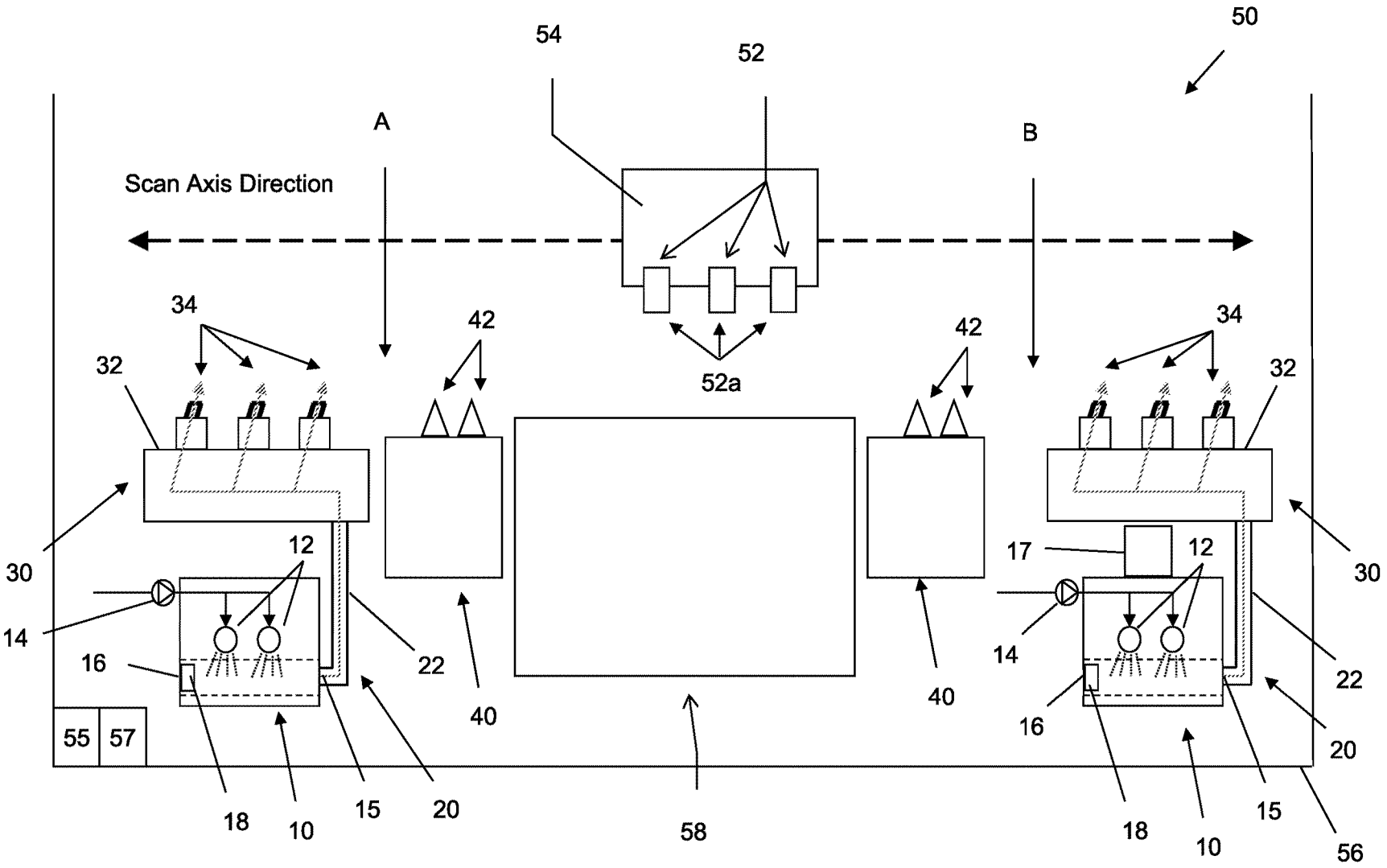
FIG. 2 is a schematic front view of a printhead servicing system with two printhead servicing subsystems installed in a scanning printing system with a printer carriage of the printing system in a first position according to one example.

FIG. 2 shows schematically a printhead servicing system installed in a scanning printer 50. The scanning printer 50 has a body portion 56 housing internal parts, which include a carriage 54, on which there are printheads 52. The printheads 52 eject printing fluid onto a printing zone 58 from nozzle plates 52*a* in the usual way. The printer 50 also includes printing fluid storage 55 and a control module 57 that are operatively linked to the carriage 54. The control module 57 is arranged to receive printing commands that are supplied to the carriage 54 in the form of instructions or signals to cause the printheads 52 to eject printing fluid for printing. In the example of FIG. 2, the wiping module 40 includes two wiping blades 42 in the form of elongate flexible members secured to a base section 44, shown from one end in FIG. 2.

In use, the printhead servicing system may be implemented as shown in FIG. 2 in which a first printhead servicing subsystem A consisting of the humidified air stream generator 10, humidified air stream channeling module 20, humidified air stream ejection module 30 and wiping module 40 is located to the left side of the printing zone 58 and a second printhead servicing subsystem B consisting of the humidified air stream generator 10, humidified air stream channeling module 20, humidified air stream ejection module 30 and wiping module 40 is located to the left side of the printing zone 58. In FIG. 2 the carriage 54 is shown as if nozzle plates 52*a* would not contact the wiper blades 42 as they pass over them, but this is just for clarity of the drawings. In fact, as mentioned above the wiper blades 42 drag across the nozzle plates 52*a* to wipe the as the carriage 54 scans across the printing zone 58.

In a typical printing cycle the carriage 54 starts in the location at the right side of the printer 50 away from the printing zone 58 and above the second printhead servicing subsystem B. The openings 34 direct the cooled and humidified air stream that has been generated in the humidified air stream generator 10 at the nozzle plates 52*a*, which will allow moisture to be absorbed by any dried printing fluid on one or more of the nozzle plates 52*a* and/or any incipient crust of printing fluid on the nozzle plates 52*a*. The nozzle plates 52*a* are also cooled by the humidified air stream. The carriage then starts to move to the left towards the position shown in FIG. 2, so that the nozzle plates are dragged over the wiper blades 42 of the wiping module, thereby wiping any excess printing fluid that has been moistened by the humidified air stream from the nozzle plates 52. The carriage 54 then prints over the printing zone 58 in the usual way. It then continues the leftward movement along the scan axis direction shown in FIGS. 2 to 4 to the position shown in FIG. 4. During this movement the carriage passes over the wiping module 40 of the first printhead servicing subsystem A and wipes excess printing fluid from the nozzle plates 52*a* to then pass over the humidified air stream ejection module 30 of the first printhead servicing subsystem A. Humidified and cooled air is thereby supplied again to the nozzle plates 52*a* to reduce dryness of any remaining printing fluid on the nozzle plates 52*a* and cool the nozzle plates 52*a*. At the leftmost position on the scanning axis, the carriage 54 changes direction to move to the right, as it does so it moves over the wiping module 40 again for the nozzle plates 52*a* to be wiped. The carriage then continues to the right for another printing operation over the printing zone 58. In continuing the rightward motion passed the position shown in FIG. 2 back to the position shown in FIG. 3, the carriage again passes over the wiping module 40 of the second printhead servicing subsystem B for further wiping of the nozzle plates 52*a*, followed by a further supply of the cooled and humidified airstream from the openings 34 of the humidified air stream ejection module 30 of the second printhead servicing subsystem B. At this stage the carriage has returned to the starting position at the location at the right side of the printer 50 away from the printing zone 58 and the printing process can continue with a repeat of the above operations.

Figure 3:
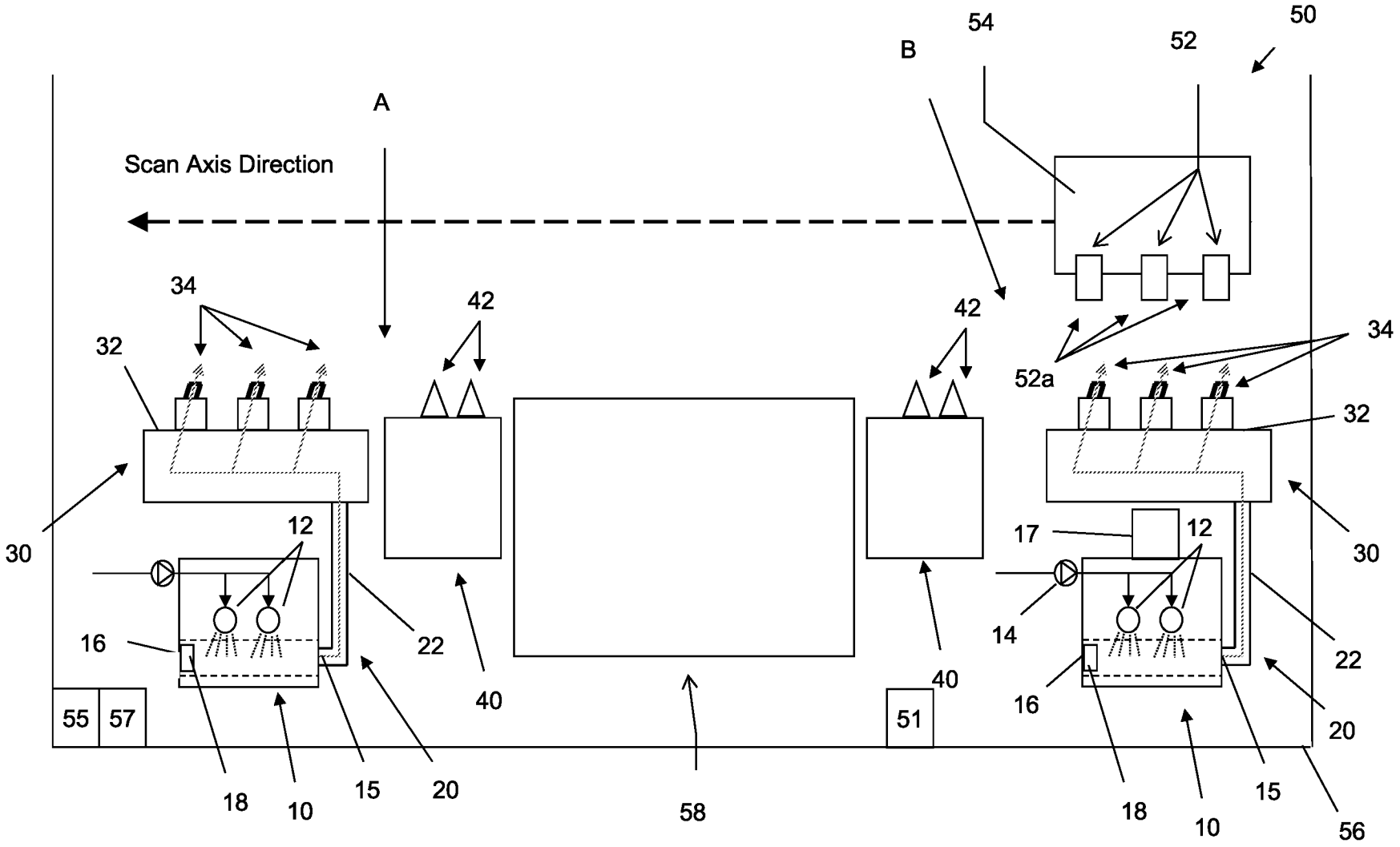
FIG. 3 is a schematic front view of the printhead servicing system of FIG. 2 with the printer carriage of the printing system in a second position according to one example.
Figure 4:
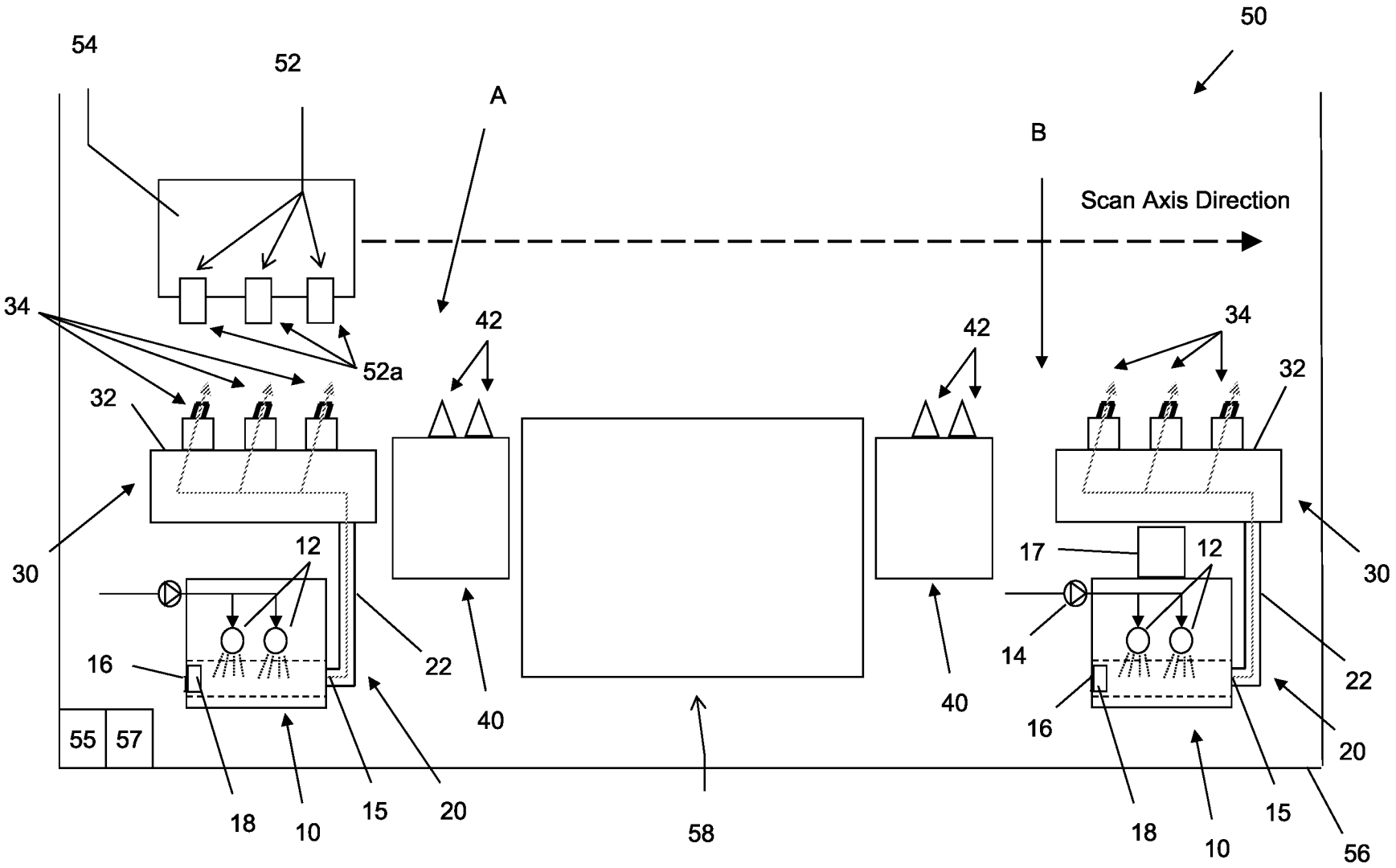
FIG. 4 is a schematic front view of the printhead servicing system of FIG. 2 with the printer carriage of the printing system in a third position according to one example.

The functioning of the printhead servicing system has been described in relation to FIGS. 2 to 4 using the example of having first and second printhead servicing subsystems A and B.

Figure 5:
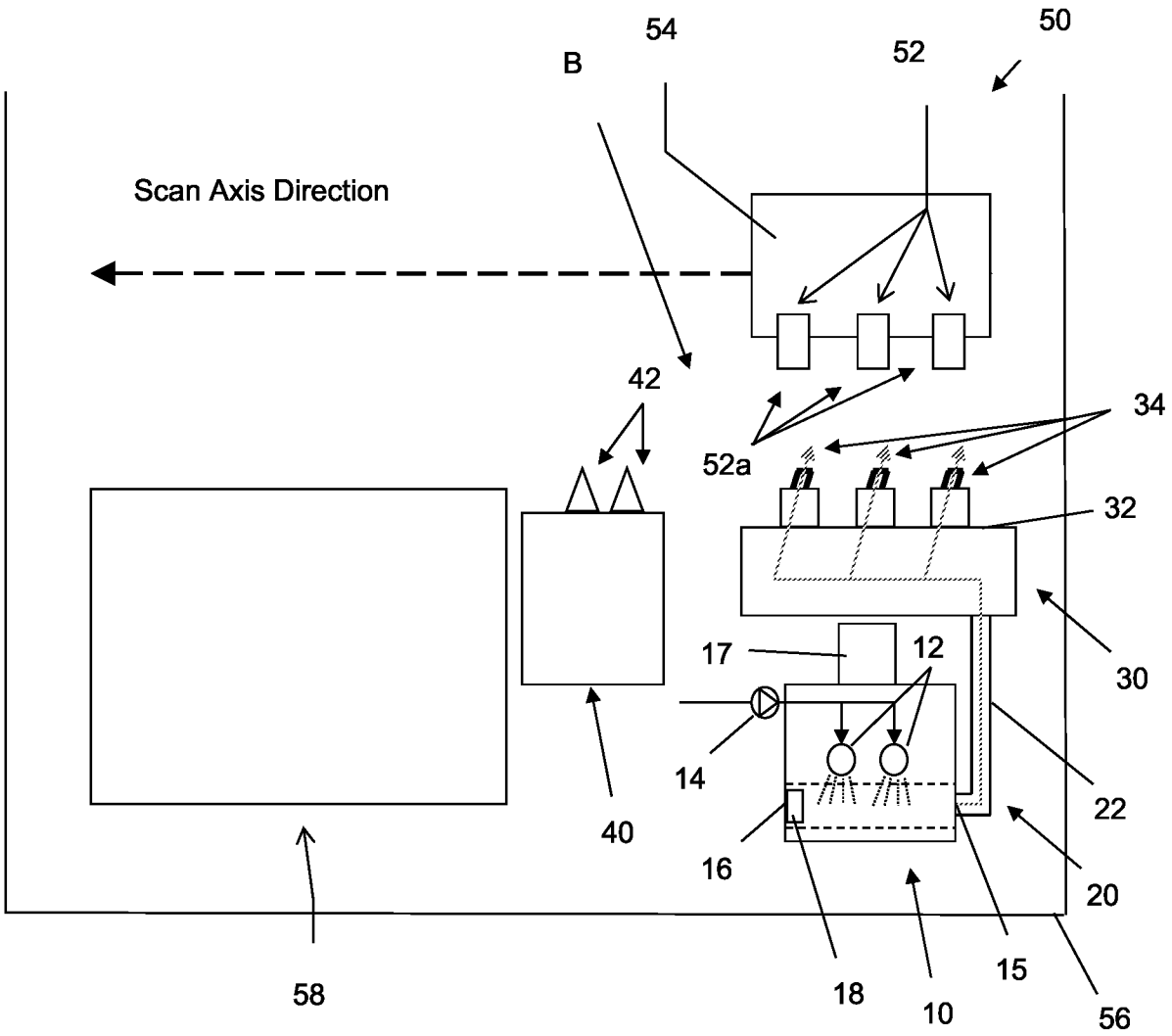
FIG. 5 is a schematic front view of a printhead servicing system with one printhead servicing subsystem installed in a scanning printing system with a printer carriage of the printing system in a first position according to one example

FIG. 5 shows an example printhead servicing system with only one printhead servicing subsystem A, which works in the same way as described above, but only wipes the nozzle plates 52*a* and supplies a humidified and cooled air stream to the nozzle plates 52*a* at one side of the printing zone 58, instead of both sides.

Figure 6:
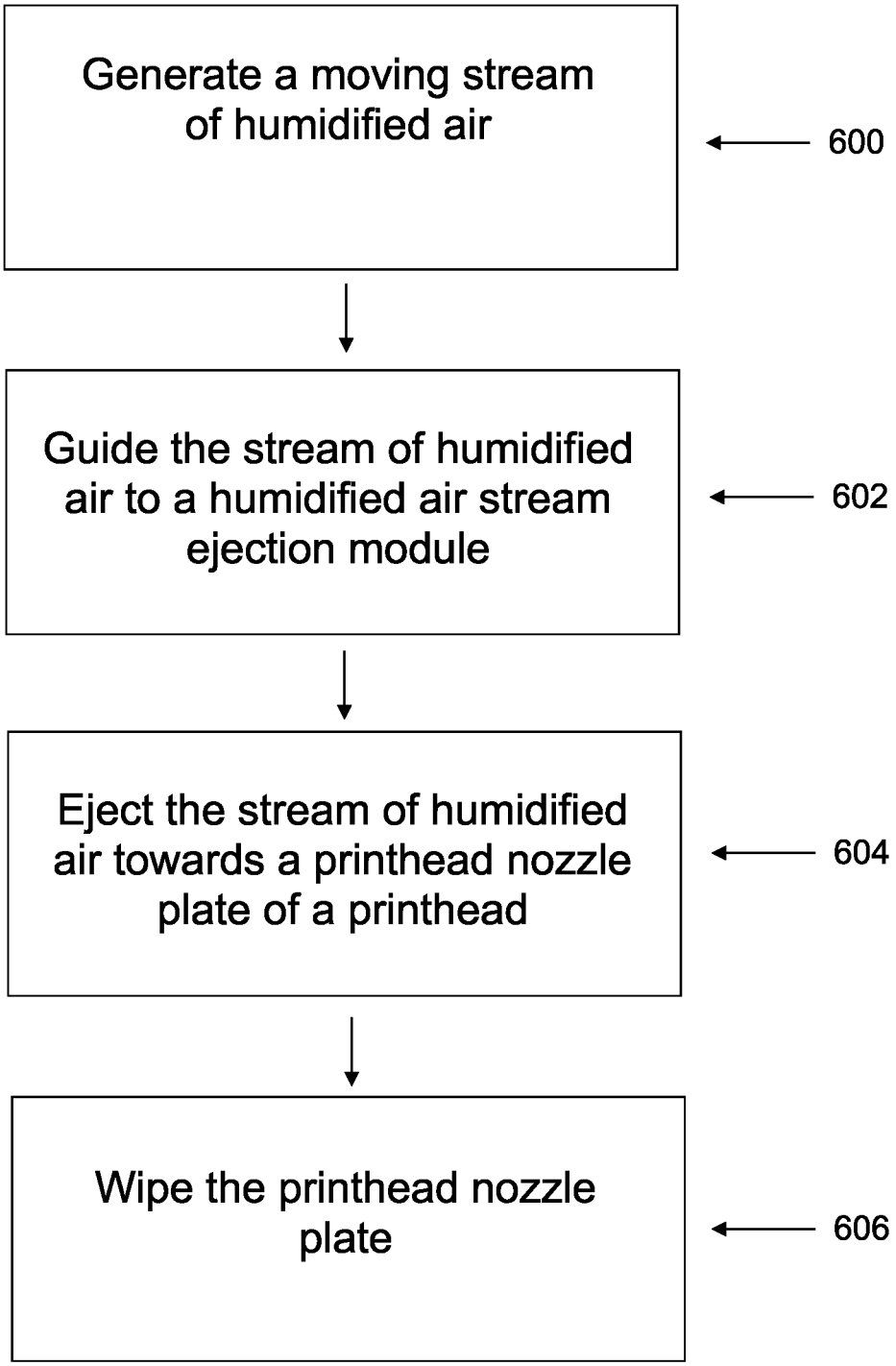
FIG. 6 is a schematic flow diagram showing method of servicing a printhead according to one example.

FIG. 6 shows the process of a method for servicing a printhead, comprising generating a moving stream of humidified air at box 600; guiding the stream of humidified air to a humidified air stream ejection module at box 602; ejecting the stream of humidified air towards a printhead nozzle plate of a printhead at box 604; and wiping the printhead nozzle plate at box 606.

The humidified air stream generator 10 is provided take an air stream from a room environment or external supply and add humidity using the mist generators so that the air stream reaches almost to dewpoint at constant enthalpy, which has the additional effect of cooling the air stream. There is a greater cooling effect if a greater amount of mist is supplied by the mist generators. However, if too much mist is supplied by the mist generators, for a given temperature and pressure in the system, then the water from the misters will not evaporate and will remain as droplets in the air stream, which droplets could be supplied to the nozzle plates.

The controller 17 is used to control the operation of one or more of the mist generators 12, water supply 14 and air stream accelerator 18 so that the humidified airstream has a high relative humidity, almost at dewpoint, in one example it may be close to 100%, as it exits the openings 34. Close to 100% relative humidity may be above 99%, or may be above 95%, or may be above 90%, or may be above 80%.

In one example the air stream accelerator 18 is operated during operation of the printing system 50 and the mist generators 12 are operated intermittently, for example when the carriage 54 approaches the printhead servicing system, to ensure that the desired humidified airstream is provided from the openings 34 when the carriage 54 is present, but the housing 56 is not provided with air at near saturation level when the carriage 54 is not in the vicinity of the printhead servicing system. In one example the printhead servicing system is not operated at every pass of the carriage passed the printhead servicing system, instead the printhead servicing system may be operated intermittently.

The printhead servicing system examples described above have printheads that are movable in a scanning movement across a print zone. Different examples are possible in which the printhead servicing system is moved relative to a stationary printhead. Other examples printing systems use a single page-wide printhead or a page-wide array of printheads. In one example a page-wide printhead is stationary in use, with a paper or print zone moved beneath the printhead. In another example a page-wide array of printheads is stationary in use, with a paper or print zone moved beneath the array of printheads. For these examples the printhead servicing system is moved relative to the page-wide printhead or page-wide array of printheads.

As described above, the nozzle plate is cooled and dried or excess printing fluid is removed. The system and method described above provide a cooled and humidified air stream that is substantially free from liquid droplets of water, which might otherwise impart liquid water or cleaning fluid to the nozzle plate in the form of droplets. Such liquid water or cleaning fluid would potentially be fired to the printing area inadvertently. It is of benefit to keep the nozzles clean and cool, whilst not allowing them to be wetted with droplets.

All of the features disclosed in this specification (including any accompanying claims, abstract and drawings), and/or all of the operations of any method or process so disclosed, may be combined in any combination, except combinations where at least some of such features and/or operations are mutually exclusive.

The invention claimed is:

1. A printhead servicing system comprising:

a humidified air stream generator to generate a humidified air stream, wherein the humidified air stream generator comprises a misting device;

a humidified air stream channeling module to channel the generated humidified air stream to a humidified air stream ejection module to eject the humidified air stream towards a printhead nozzle plate of a printer; and a wiping module to wipe the printhead nozzle plate of the printer.

2. The printhead servicing system of claim 1, wherein the humidified air stream generator comprises an air stream accelerator.

3. The printhead servicing system of claim 1, in wherein the misting device is a cooling or neutral temperature misting device, providing cooling or neutral temperature change to mist.

4. The printhead servicing system of claim 3, wherein the misting device is an ultrasonic mist generator, the ultrasonic mist generator to use pressurized water forced through an atomizing nozzle, or the ultrasonic mist generator to use ambient pressure water forced through the atomizing nozzle with compressed air.

5. The printhead servicing system of claim 1, wherein the humidified air stream channeling module comprises at least one duct to allow droplets of water in the humidified air stream to disperse before reaching the humidified air stream ejection module.

6. The printhead servicing system of claim 1, wherein the humidified air stream ejection module comprises a chamber to receive the humidified air stream from the humidified air stream channeling module.

7. The printhead servicing system of claim 6, wherein the chamber comprises at least one outlet nozzle to direct the humidified air stream to the printhead nozzle plate for servicing.

8. A method of servicing a printhead, the method comprising:

generating a moving stream of humidified air, wherein generating the moving stream of humidified air comprises generating a mist from a source of water;

guiding the stream of humidified air to a humidified air stream ejection module;

ejecting the stream of humidified air towards a printhead nozzle plate of a printhead; and wiping the printhead nozzle plate.

9. The method of claim 8, wherein generating the moving stream of humidified air comprises accelerating the generated mist towards the humidified air stream ejection module.

10. The method of claim 8, further comprising channeling the stream of humidified air to allow droplets of water in the moving stream of humidified air to disperse before reaching the humidified air stream ejection module.

11. The method of claim 8, wherein ejecting the stream of humidified air towards the printhead nozzle plate is performed prior to the wiping the printhead nozzle plate.

12. The method of claim 8, wherein a printhead servicing and printing cycle comprises: ejecting the stream of humidified air towards the printhead nozzle plate for servicing, followed by wiping the printhead nozzle plate for servicing, followed by a printing operation.

13. A printing system having at least one printing fluid ejecting printhead to eject droplets of printing fluid, the printing system having a printhead servicing system, the printhead servicing system comprising:

a humidified air stream generator to produce a humidified air stream, wherein the humidified air generator comprises a misting device;

a humidified air stream channeling module to convey the generated humidified airstream to a humidified air stream ejection module to eject the humidified air stream towards a printhead nozzle plate of a printing system; and a wiping module to wipe the printhead nozzle plate of the printing system.

* * * * *